US005447216A

United States Patent [19]

Freyvogel

[11] Patent Number: 5,447,216

[45] Date of Patent: Sep. 5, 1995

[54] DIVE GEAR VALET CASE

[76] Inventor: Frank C. Freyvogel, 2061 Waltoffer Ave., North Bellmore, N.Y. 11710

[21] Appl. No.: 124,578

[22] Filed: Sep. 22, 1993

[51] Int. Cl.[6] ..... A45C 5/14; A45C 13/26; A45C 13/30

[52] U.S. Cl. ..... 190/18 A; 190/109; 190/115; 206/289; 206/292; 206/315.1; 383/117

[58] Field of Search ..... 190/13 R, 18 A, 115, 190/109, 110, 100, 102, 903, 24; 405/185, 186; 224/153, 209; 206/289, 803, 292, 315.1; 383/117, 103

[56] References Cited

U.S. PATENT DOCUMENTS

| | | | |
|---|---|---|---|
| 1,599,316 | 9/1926 | Bullock | 190/13 R |
| 3,254,756 | 6/1966 | Rankin | 206/803 X |
| 4,506,769 | 3/1985 | Franco et al. | 224/209 X |
| 4,752,263 | 6/1988 | Pritchard et al. | 224/153 X |
| 4,790,463 | 12/1988 | Hansen | 224/153 X |
| 4,883,207 | 11/1989 | McArthur | 224/153 |
| 4,946,313 | 8/1990 | Augurelli | 405/186 |
| 4,949,842 | 8/1990 | Mokiao, II | 383/117 X |
| 4,952,095 | 8/1990 | Walters | 405/186 |
| 5,012,964 | 5/1991 | Falletta et al. | 383/103 X |
| 5,105,920 | 4/1992 | Grebenstein | 190/111 X |
| 5,267,815 | 12/1993 | Feder | 405/186 |
| 5,295,565 | 3/1994 | Latshaw | 190/24 X |
| 5,316,178 | 5/1994 | Garber, Jr. | 206/523 X |
| 5,323,897 | 6/1994 | Sperber | 383/117 X |

FOREIGN PATENT DOCUMENTS

| | | | |
|---|---|---|---|
| 1027919 | 3/1928 | Canada | 206/803 |
| 358125 | 6/1922 | France | 190/13 R |
| 813280 | 2/1937 | France | 224/209 |
| 835030 | 12/1938 | France | 190/109 |
| 1474142 | 3/1967 | France | 190/903 |
| 2509156 | 1/1983 | France | 190/13 R |
| 3841362 | 6/1990 | Germany | 190/109 |
| 405442 | 2/1934 | United Kingdom | 190/111 |
| 1539021 | 1/1979 | United Kingdom | 190/18 A |

*Primary Examiner*—Sue A. Weaver
*Attorney, Agent, or Firm*—Michael I. Kroll

[57] ABSTRACT

A dive gear valet case is provided which consists of a receptacle having a plurality of compartments for storing various dive gear equipment therein. A cover is hinged to the receptacle to close over the receptacle. A mechanism is transporting the receptacle with the cover along a surface, so that the dive gear valet case can be moved to different locations.

10 Claims, 2 Drawing Sheets

DIVE GEAR VALET CASE

BACKGROUND OF THE INVENTION

1. Field of the Invention

The instant invention relates generally to storage devices and more specifically it relates to a dive gear valet case.

2. Description of the Prior Art

Numerous storage devices have been provided in prior art that are adapted to hold various articles therein, so that the various articles can be carried from place to place. While these units may be suitable for the particular purpose to which they address, they would not be as suitable for the purposes of the present invention as heretofore described.

SUMMARY OF THE INVENTION

A primary object of the present invention is to provide a drive gear valet case that will overcome the shortcomings of the prior art devices.

Another object is to provide a dive gear valet case that is fabricated out of a high-impact material, so that it can transport dive gear on aircraft for use on dive boats and/or beach dives.

An additional object is to provide a dive gear valet case that can be utilized for winter storage and is waterproof, so that equipment may be cleaned.

A further object is to provide a dive gear valet case that is simple and easy to use.

A still further object is to provide a dive gear valet case that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
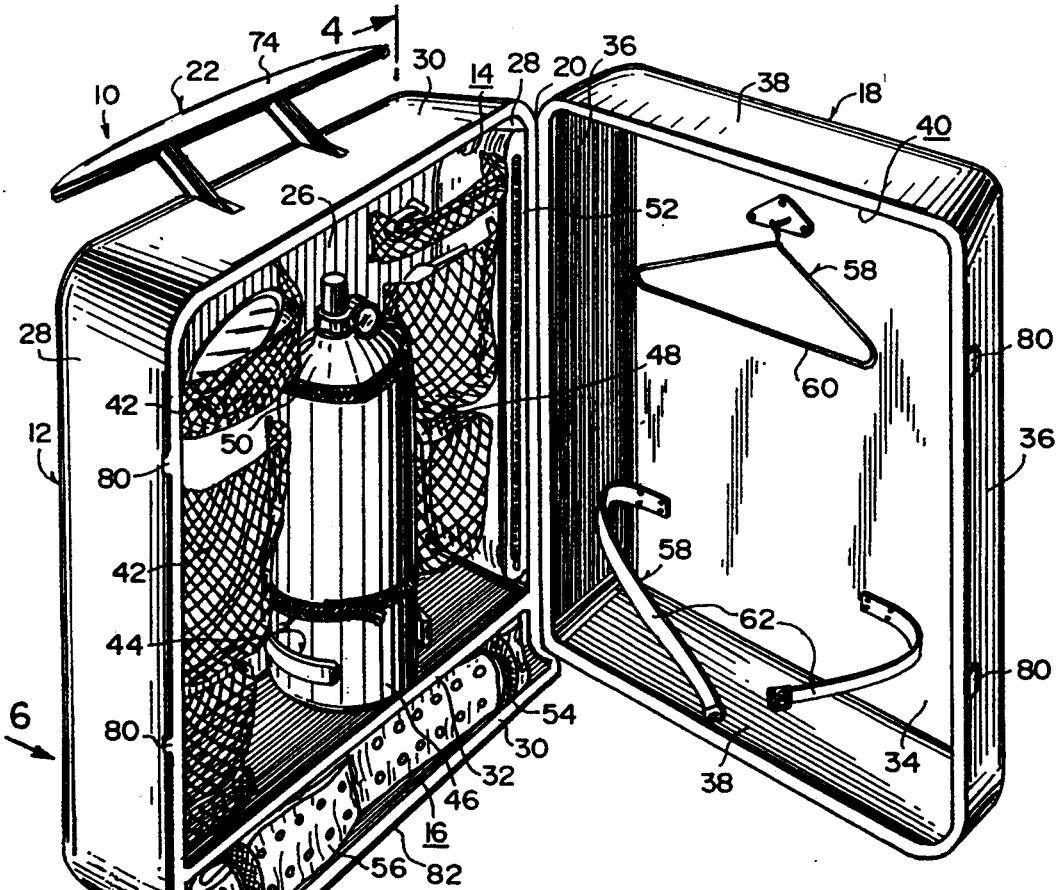
FIG. 1 is a perspective view of the present invention with the cover partly opened.
Figure 2:
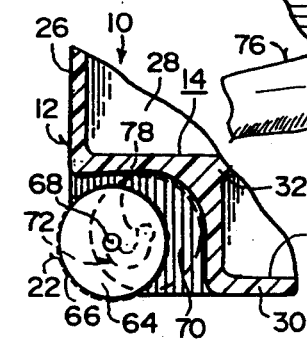
FIG. 2 is a cross sectional view of a portion of the receptacle showing the cylindrical wheel in greater detail.
Figure 3:
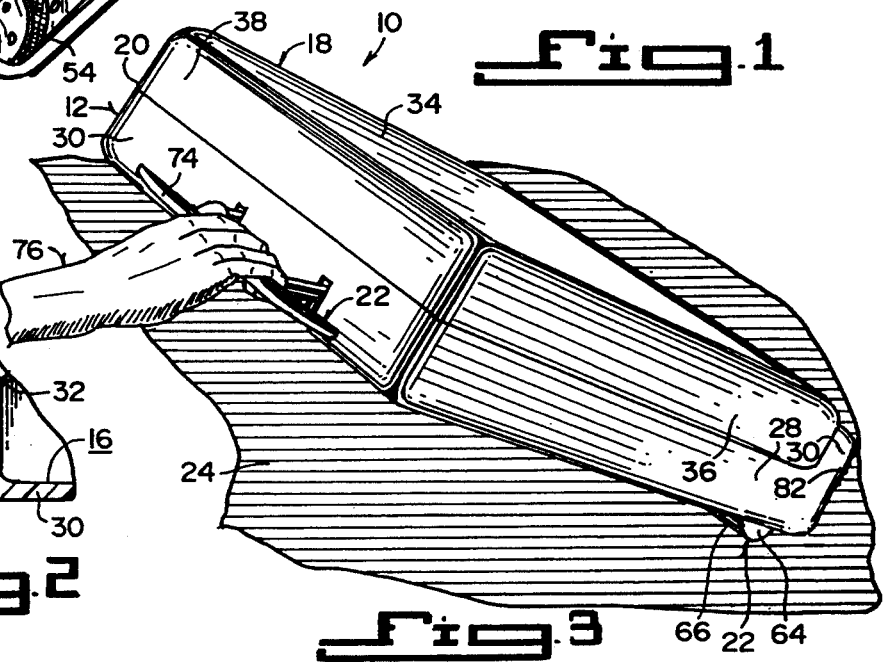
FIG. 3 is a perspective view of the present invention closed and being pulled by the pop-up handle.

Turning now descriptively to the drawings, in which similar reference characters denote similar elements throughout the several views, the Figures illustrate a dive gear valet case 10, which consists of a receptacle

12 having a plurality of compartments 14, 16 for storing various dive gear equipment therein. A cover 18 is hinged at 20 to the receptacle 12 to close over the receptacle. A mechanism 22 is for transporting the receptacle 12 with the cover 18 along a surface 24, so that the dive gear valet case 10 can be moved to different locations.

The receptacle 12 includes a back wall 26, a pair of extending side walls 28, a pair of extended end walls 30 and an extending partition wall 32 parallel to the end walls 30 for dividing the receptacle 12 into one large compartment 14 and one small compartment 16.

The cover 18 includes a front wall 34, a pair of extending side walls 36 and a pair of extending end walls 38, so as to form one complete compartment 40 therein.

A plurality of different sized elastic fish-net stowage members 42 are affixed about the large compartment 14 in the receptacle 12 for holding some of the various dive gear equipment therein. The dive gear valet case 10 further includes a structure 44 for retaining an air tank 46 within the large compartment 14 in the receptacle 12.

The air tank retaining structure 44 includes a pair of spaced apart air tank cradles 48 mounted to the interior of the back wall 26 of the receptacle 12. A pair of spaced apart air tank retainer straps 50 are also affixed to the interior of the back wall 26 of the receptacle 12.

A padded zipper pocket stowage member 52 is for holding a regulator therein, which is removably positioned within the large compartment 14 in the receptacle 12 against one of the side walls 28 adjacent the hinged cover 18. A pair of spaced apart elastic bands 54 are mounted within the small compartment 16 in the receptacle 12 for holding a weight belt 56 therein.

An apparatus 58 is for retaining a dive suit within the one complete compartment 40 in the cover 18. The dive suit retaining apparatus 58 includes a hanger 60 mounted to the interior of the front wall 34 of the cover 18 and a retaining strap 62 mounted to the interior of the front wall 34 of the cover 18 below the hanger 60.

The transporting mechanism 22 includes a cylindrical wheel 64 having a ribbed circumference 66 for better traction, typically in soft sand and should be somewhat flexible, so as to absorb shock on a hard surface. An axle 68 extends through the cylindrical wheel 64 to be rotatably mounted within a lower rear recessed portion 70 of the receptacle 12. A structure 72 is for retracting the cylindrical wheel 64 upwardly, so that the bottom end wall 30 can sit squarely on the surface 24. A pop-up handle 74 is pivotally mounted to the top end wall 30 of the receptacle 12. In a first instance, when the handle 74 is in an up position, a person 76 can grip the handle 74 and pull the dive gear valet case 10 therealong. In a second instance, when the handle 74 is in a down position, it can be used as a hanger for clothes and similar articles.

The retracting structure 72 includes each opposite end of the lower rear recessed portion 70 of the receptacle 12 having a J-shaped slot 78 to receive one end of the axle 68, so that the cylindrical wheel 64 can be raised and lowered with respect to the bottom end wall 30.

The dive gear valet case 10 further includes a pair of spaced apart locking hasps 80 between the side wall 28 of the receptacle 12 and the side wall 36 of the cover 18 opposite from the side walls 25, 36 at hinge 20. When the cover 18 is placed in a closed position over the receptacle 12, the locking hasps 80 will keep the cover 18 closed thereon. The bottom end wall 30 of the receptacle 12 has a non-skid exterior 82, so that when the cylindrical wheel 64 is raised the bottom end wall 30 will not slide upon the surface 24.

Figures 4, 5, 6, 7:
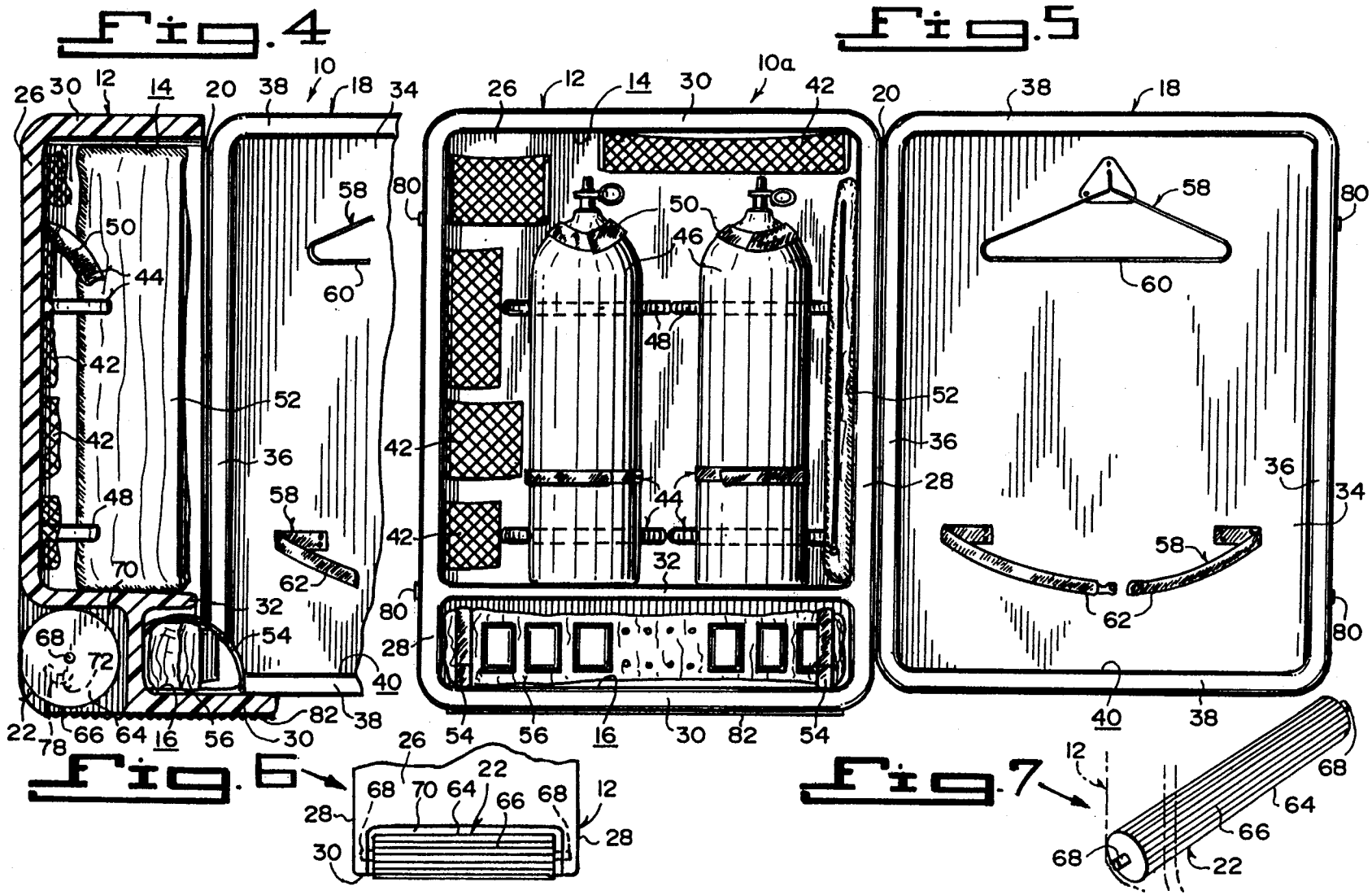
FIG. 4 is a cross sectional view taken generally along line 4—4 in FIG. 1.
FIG. 5 is a front elevational view of a modification with the cover completely opened showing two air tanks carried within the receptacle.
FIG. 6 is a rear view taken in direction of arrow 6 in FIG. 1 with parts broken away showing the cylindrical wheel therein.
FIG. 7 is a perspective view of the cylindrical wheel per se.

A modified dive gear valet case 10*a* is shown in FIG. 5, in which two of the air tank retaining structures 44 are in a side by side relationship within the large compartment 14 in the receptacle 12, so that two air tanks 46 can be carried within the receptacle 12.

| LIST OF REFERENCE NUMBERS | |
|---|---|
| 10 | dive gear valet case |
| 10a | modified drive gear valet case |
| 12 | receptacle |
| 14 | large compartment in 12 |
| 16 | small compartment in 12 |
| 18 | cover |
| 20 | hinge |
| 22 | transporting mechanism |
| 24 | surface |
| 26 | back wall of 12 |
| 28 | side wall of 12 |
| 30 | end wall of 12 |
| 32 | partition wall in 12 |
| 34 | front wall of 18 |
| 36 | side wall of 18 |
| 38 | end wall of 18 |
| 40 | one complete compartment in 18 |
| 42 | elastic fish-net stowage member |
| 44 | air tank retaining structure |
| 46 | air tank |
| 48 | air tank cradle |
| 50 | air tank retainer straps |
| 52 | padded zipper pocket stowage member |
| 54 | elastic band |
| 56 | weight belt |
| 58 | dive suit retaining apparatus |
| 60 | hanger |
| 62 | retaining strap |
| 64 | cylindrical wheel |
| 66 | ribbed circumference on 64 |
| 68 | axle |
| 70 | lower rear recessed portion of 12 |
| 72 | retracting structure |
| 74 | pop-up handle |
| 76 | person |
| 78 | J-shaped slot |
| 80 | locking hasp |
| 82 | non-skid exterior on bottom 30 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dive gear valet case which comprises:

a) a receptacle having a plurality of compartments for storing various dive gear equipment therein, said receptacle including a back wall, a pair of extending side walls, top and bottom extending end walls, an extending partition wall parallel to said end walls for dividing said receptacle into one large compartment and one small compartment;

b) a cover hinged to said receptacle to close over said receptacle, said cover including a front wall, a pair of extending side walls, and a pair of extending end walls, so as to form one complete compartment therein;

c) means for transporting said receptacle with said cover along a surface, so that said dive gear valet case can be moved to different locations;

d) a plurality of different sized elastic fish-net stowage members affixed about the large compartment in said receptacle for holding some of the various dive gear equipment therein; and e) means for retaining an air tank within the large compartment in said receptacle, said air tank retaining means including a pair of spaced apart air tank cradles mounted to the interior of said back wall of said receptacle, and a pair of spaced apart air tank retainer straps affixed to the interior of said back wall of said receptacle.

2. A dive gear valet case as recited in claim 1, further including a padded zipper pocket stowage member for holding a regulator therein, which is removably positioned within the large compartment in said receptacle against one of said side walls adjacent said hinged cover.

3. A dive gear valet case as recited in claim 2, further including a pair of spaced apart elastic bands mounted within the small compartment in said receptacle for holding a weight belt therein.

4. A dive gear valet case as recited in claim 3, further including means for retaining a dive suit within the one complete compartment in said cover.

5. A dive gear valet case as recited in claim 4, wherein said dive suit retaining means includes:

a) a hanger mounted to the interior of said front wall of said cover; and b) a retaining strap mounted to the interior of said front wall of said cover below said hanger.

6. A dive gear valet case as recited in claim 5, wherein said transporting means includes:

a) a cylindrical wheel having a ribbed circumference for better traction;

b) an axle extending through said cylindrical wheel to be rotatably mounted within a lower rear recessed portion of said receptacle;

c) means for retracting said cylindrical wheel upwardly, so that said bottom end wall can sit squarely on the surface; and d) a pop-up handle pivotally mounted to said top end wall of said receptacle, so that in a first instance when said handle is in an up position, a person can grip said handle and pull said dive gear valet case therealong, and in a second instance when said handle is in a down position, it can be used as a hanger for clothes and similar articles.

7. A dive gear valet case as recited in claim 6, wherein said retracting means includes each opposite end of the lower rear recessed portion of said receptacle having a J-shaped slot to receive one end of said axle, so that said cylindrical wheel can be raised and lowered with respect to said bottom end wall.

8. A dive gear valet case as recited in claim 7, further including a pair of spaced apart locking hasps between said side wall of said receptacle and said side wall of said cover opposite from said hinged side walls, so that when said cover is placed in a closed position over said receptacle said locking hasps will keep said cover closed thereon.

9. A dive gear valet case as recited in claim 8, further including said bottom end wall of said receptacle having a non-skid exterior, so that when said cylindrical wheel is raised said bottom end wall will not slide upon the surface.

10. A dive gear valet case as recited in claim 9 further including two said air tank retaining means being in a side by side relationship within the large compartment in said receptacle, so that two air tanks can be carried within said receptacle.

* * * * *